US012152349B2

(12) United States Patent
Schultz et al.

(10) Patent No.: US 12,152,349 B2
(45) Date of Patent: Nov. 26, 2024

(54) RAIL BALLAST MANAGEMENT AND TIE GUIDE SKI FOR USE WITH RAIL TIE EXCHANGER

(71) Applicant: NORDCO INC., Oak Creek, WI (US)

(72) Inventors: Nichalos L. Schultz, Lindenhurst, IL (US); Matthew J. Orvedahl, Racine, WI (US); Neil P. Creegan, Wauwatosa, WI (US); Mark D. David, Milwaukee, WI (US); Jerry J. Jacobs, Delafield, WI (US); Samuel E. Zauner, Kenosha, WI (US)

(73) Assignee: Nordco, Inc., Oak Creek, WI (US)

( * ) Notice: Subject to any disclaimer, the term of this patent is extended or adjusted under 35 U.S.C. 154(b) by 910 days.

(21) Appl. No.: 17/220,642

(22) Filed: Apr. 1, 2021

(65) Prior Publication Data

US 2021/0317617 A1 Oct. 14, 2021

Related U.S. Application Data

(60) Provisional application No. 63/007,699, filed on Apr. 9, 2020.

(51) Int. Cl.
*E01B 29/10* (2006.01)

(52) U.S. Cl.
CPC ..... *E01B 29/10* (2013.01)

(58) Field of Classification Search
CPC ..... E01B 29/10
See application file for complete search history.

(56) References Cited

U.S. PATENT DOCUMENTS 2,966,122 A * 12/1960 Kdropp ..... E01B 33/02 104/8
4,418,625 A * 12/1983 Allmer ..... E01B 29/10 104/9
4,579,060 A * 4/1986 Nameny ..... E01B 29/10 104/9
4,770,103 A * 9/1988 Allmer ..... E01B 29/10 104/9
5,048,424 A * 9/1991 Madison ..... E01B 29/10 104/9
5,431,107 A * 7/1995 Almaraz ..... E01B 29/24 104/2
5,722,325 A 3/1998 Glomski et al.
6,463,858 B2 10/2002 Weber et al.
(Continued)

*Primary Examiner* — Scott A Browne
(74) *Attorney, Agent, or Firm* — K&L Gates LLP

(57) ABSTRACT

A rail ballast management and tie guide ski is provided for use with a rail tie exchanger machine moving along a railroad track. The assembly includes a workhead frame configured for attachment to the tie exchanger, the workhead frame having a vertically oriented sleeve defining a cavity, a tie ski having a generally planar tie engaging surface, an opposite upper surface, a connection point at each of two free ends, and a mounting lug is dimensioned for slidably engaging the cavity, and is pivotally connected to the tie ski. Also connected to said tie guide ski assembly is a pair of fluid power cylinder assemblies, one said cylinder assembly connected to a respective connection point at a first end, and to the sleeve at an opposite second end, such that selective pressurization of said fluid power cylinder assemblies causes reciprocal movement of said tie ski relative to said sleeve.

16 Claims, 5 Drawing Sheets

(56) References Cited

U.S. PATENT DOCUMENTS

| | | | | |
|---|---|---|---|---|
| 6,863,717 | B2 | 3/2005 | Johnsen et al. | |
| 2011/0094624 | A1* | 4/2011 | Lee, Jr. ..... | E01B 31/22<br>144/133.3 |
| 2018/0274181 | A1* | 9/2018 | Berglund ..... | E01B 29/32 |
| 2020/0087863 | A1 | 3/2020 | Boczkiewicz et al. | |
| 2020/0131716 | A1 | 4/2020 | Pritzl et al. | |

* cited by examiner

RAIL BALLAST MANAGEMENT AND TIE GUIDE SKI FOR USE WITH RAIL TIE EXCHANGER

RELATED APPLICATION

The present application is a Non-Provisional of, and claims priority under 35 USC 119 from U.S. Provisional application 63/007,699 filed Apr. 9, 2020, the contents of which are incorporated by reference herein.

BACKGROUND

This invention relates generally to railway right-of-way maintenance equipment of the type used to repair and maintain railroad track. More specifically, the present invention relates to an apparatus for reducing the effect of stray ballast in hindering the replacement of rail ties.

Conventional railroad track consists of a plurality of spaced parallel wooden ties, to which are attached a pair of spaced rail tie plates. The ties are supported in a bed of loose rocks known as ballast. Each tie plate is configured to rest on the upper surface of the tie and includes holes for receiving spikes or screws, as well as a canted seat or a cradle formation for receiving the bottom or foot of the steel rail. Since two rails make up a railroad track, there are a pair of spaced tie plates on each tie. Some of the spikes are used to secure the tie plate on the tie, and others are used to secure the rail foot to the tie plate cradle.

During track maintenance operations, it is common to periodically remove worn out or rotten ties. This is accomplished by first removing the spikes which hold the plates to the tie as well as to the rail. Next, a machine, such as is disclosed in commonly-assigned U.S. Pat. No. 6,463,858, incorporated by reference, lifts the rail and extracts the worn tie from underneath. The tie is slid transversely out from beneath the rails. As the tie is extracted, the loosened tie plates either fall into the rail bed or ballast, or are retained on the removed tie. Conventional practice is to manually remove the plates and then throw them off to the side of the ballast so they do not interfere with the replacement procedure of the new tie.

One system for handling the plates automatically during the tie replacement process is disclosed in commonly-assigned U.S. Pat. No. 6,863,717 which is incorporated by reference. Using this machine, the tie plates are grasped at the forward and rear edges with respect to the direction of travel along the track and are held suspended above the rails while the tie is extracted.

Another approach to the problem of tie plate handling is disclosed in U.S. Pat. No. 5,722,325. In this machine, the tie plates are grasped and held to the rail while the tie is extracted. A pair of jaws grasp the target tie plate along the forward and rear side edges with respect to the direction of travel on the track. A fluid-powered, preferably hydraulic cylinder is connected to both jaws to exert the gripping force. In practice, this apparatus has encountered difficulty in centering the force on the target plate, which has interfered with efficient plate handling. Also, the mechanism disclosed in the '325 patent has proved difficult to use when the tie plates are not aligned on the tie, which often occurs in lengths of curved track, or when ties are subject to warping.

Another tie plate handling apparatus is disclosed in U.S. Pat. No. 5,722,325. Gripper jaws engage forward and rear edges of the tie plates and grasp the plates in place and hold the plate against the rail while the tie is removed. Pairs of gripper jaws are provided on both the field side and the gauge side of the rail. Tie removal is in a transverse direction to the action of the plate gripper jaws. A single fluid power cylinder operates each pair of jaws, with one jaw each connected respectively to the rod and blind end of the cylinder. A spring arrangement is provided for centering the opposing jaws, which move along a guide shaft. In practice, this apparatus has not met expectations for reliable centering of the plate.

Another aspect of the machine disclosed in the '325 patent is a horizontally oriented fluid powered cylinder connected to a scissors jack. This apparatus is used to vertically move the plate handling portion of the workhead relative to a main workhead frame between a raised, travel position, and a lowered, working position. The fluid powered cylinder reciprocates in a direction parallel to the ties and transverse to a longitudinal axis of the rails.

Other relevant rail tie replacement machines are disclosed in commonly assigned U.S. patent application Ser. Nos. 16/549,422 and 16/660,629, which are incorporated by reference here. In all known mechanisms for replacing rail ties, it is not uncommon for stray rocks or particles of ballast to be retained on the rail plates or the newly inserted ties in locations that impede the operation of the rail maintenance equipment. Stray rocks often become wedged between the ties or rail plates and the corresponding handling equipment.

In conventional railroad maintenance equipment as described above which is designed for replacing rail ties, it is not uncommon for the operation of such equipment to require highly skilled operators to achieve desired operational cycle times. If the productivity of the machine is reduced, the economic viability of the machine is in jeopardy.

Thus, there was a need for an improvement to existing rail tie replacement equipment to aid the operator and reduce their workload, as far as the number of things they needed to manage while inserting a tie. In conventional equipment, the operator is constantly trying to keep the top of the tie clean, while keeping it at the correct level to push under the plate. The two tasks are counter to each other, such that in order to insert the tie under the tie plate, the tie is dug deeper into the ballast, which causes increased amounts of stray ballast on top of the plate. Another need is an improved rail tie insertion device that enhances the ability of the operator to visually aim the tie at the correct depth.

One common approach to the problem involves scrapers which acted only on a very limited section of the tie. By the time the tie was in the area for the scrapers to act, the ballast pile could be very large and hard to clean, requiring extra movement of the tie to clean it. Another problem of stray ballast during the tie replacement process is that proper tie placement often involves multiple reinsertions of the new tie into the rail bed. Such effort delays the entire railway rebuilding process.

SUMMARY

The above-listed needs are met or exceeded by the present rail ballast management and tie guide ski assembly for use with a rail tie exchanger. A feature of the present assembly is a full-length tie ski acting as a scraper/ballast management device that works in conjunction with a plate handler that holds the rail plates in place. An important purpose of the present tie ski is to provide a guide for tie insertion height, while keeping the top of the tie clear of ballast and other debris. The present structure allows the operator to install a tie with less skill, and at faster cycling rates, while reducing the occurrence of low ties as well as reducing the occurrence of stray ballast between the tie and the plate.

Another feature of the present tie ski is that it reduces the skill required by the operator to use the machine. By reducing the skill level of the operator, the managing entity of the railway maintenance project, typically the railroad, has an easier job of locating appropriate employees to staff the machine for efficient production. When skilled operators are present, the present assembly further improves operational efficiency.

By using the present tie ski during rail tie insertion, the top of the rail tie remains clean and relatively free of stray ballast. In addition, the tie ski provides a physical barrier that retains the tie at a preselected depth during the entire insertion.

In operation, the present tie ski is employed as follows: First, the tie plates are clamped by the maintenance machine, and the old tie is extracted laterally away from the track. Next, once the old tie is fully extracted, the operator actuates a cycle button to deploy the tie ski from a retracted, travel or ready position and automatically tilt it to the correct side. It is contemplated that this operation will not negatively impact cycle time because the operator is obtaining the new tie while the tie ski deploys. After the new tie is obtained, the operator inserts the first 3-6 inches of tie beneath the closest or insert side tie plate. Next, the operator uses the gripping claws to reach to the far outside of the tie and applies downward force on the tie to begin the insertion.

During insertion, as the new tie is inserted, the tie ski comes in contact with an upper surface of the tie and acts as a positive stop to prevent the tie from being inserted at too high an elevation. Also, using the present assembly with the tie ski, the process of tie insertion is converted to a 1-2 push operation that reduces digging in the ballast, and keeps the ties in closer engagement with a foot of the rail.

In the preferred embodiment, the present assembly utilizes two, back-to-back or end-to-end fluid power (preferably hydraulic) cylinders for deploying the tie ski. The cylinder assembly includes a first, longer cylinder secured to a second, shorter cylinder. The longer cylinder acts to deploy the ski into position. The position is controllable in the machine cab by the operator to reach the correct height for the tie/rail combination. The ski, when level, creates a near continuous surface to push the tie in against. While the ski is deploying, the side opposite the current insertion side will drop down an additional 3" below the top of plate. The longer cylinder will lock in place to keep a rigid guide to keep the tie from being inserted too high, while the smaller cylinder pushes down with reduced pressure but sufficient to maintain constant contact with the tie's leading edge, thus keeping the new inserted tie clear of ballast. In the preferred embodiment, the tie ski is a reinforced plate that allows the tie to scrape across continuously during the insertion process.

More specifically, a rail ballast management and tie guide ski assembly is provided for use with a rail tie exchanger moving along a railroad track. The assembly includes a workhead frame configured for attachment to the tie exchanger, the workhead frame having a vertically oriented sleeve defining a cavity, a tie ski having a generally planar tie engaging surface, an opposite upper surface, a connection point at each of two free ends, and a mounting lug is dimensioned for slidably engaging the cavity, and is pivotally connected to the tie ski.

Also connected to said tie guide ski assembly is a pair of fluid power cylinder assemblies, one such cylinder assembly connected to a respective connection point at a first end, and to the sleeve at an opposite second end, such that selective pressurization of said fluid power cylinder assemblies causes reciprocal movement of the tie ski relative to the sleeve.

In an embodiment, the workhead frame has a longitudinal axis, and the tie ski is mounted transversely to the longitudinal axis. Also, in an embodiment, the workhead frame is provided with mounting brackets at each of two ends, the brackets configured for mounting to the rail tie exchanger. Also, preferably the workhead frame includes two arms, one each connected at an inner end to the sleeve. In an embodiment, the sleeve has a pair of pivot brackets at an upper end, and the upper end of the sleeve is preferably closed.

Also it is preferred that the tie ski has a pair of vertically projecting side rails. Each side rail is provided with a mounting point for a lower end of the mounting lug. In addition, each connection point on the tie ski is a pivot joint. Further, the fluid power assembly includes a pair of cylinders mounted end-to-end. Each pair of cylinders includes a first long cylinder, connected to a second, short cylinder, and the first cylinder is disposed closer to the tie ski than the second cylinder. Also, the first cylinder is connected to the connection point, and the second cylinder is connected to the sleeve. In a preferred embodiment, the fluid power assemblies are each individually controlled, so that one end of the tie ski is movable independently of the other tie ski end. At least one bearing pad is preferably disposed between the mounting lug and the sleeve.

In another embodiment, a rail tie exchanger is provided, including a main frame having a pair of spaced apart members defining a work space, a tie ski workhead frame configured for attachment to the spaced apart members of the main frame, the workhead frame having a vertically oriented sleeve defining a cavity. A tie ski has a generally planar tie engaging surface, an opposite upper surface, a connection point at each of two free ends; a mounting lug dimensioned for slidably engaging the cavity, and pivotally connected to the tie ski. A pair of fluid power cylinder assemblies is provided, one such assembly connected to a respective connection point at a first end, and to the sleeve at an opposite second end, such that selective pressurization of the fluid power cylinder assemblies causes reciprocal movement of the tie ski relative to the sleeve.

In still another embodiment, a method of extraction and insertion of a tie on a railroad track using a rail tie extractor, is provided, including:

pulling an existing tie laterally from beneath rails of the track;

providing a vertically reciprocating tie ski slidable relative to a sleeve between a retracted position and an extended position;

as a new tie is positioned for insertion beneath the rails, activating the tie ski to the extended position;

further activating the tie ski so that one end of the ski is tilted relative to another end;

manipulating the new tie so that an insertion end of the tie engages a lower end of the tie ski; and once the tie ski is engaged on an upper surface of the tie, completing the tie insertion process.

DETAILED DESCRIPTION

Figure 1:
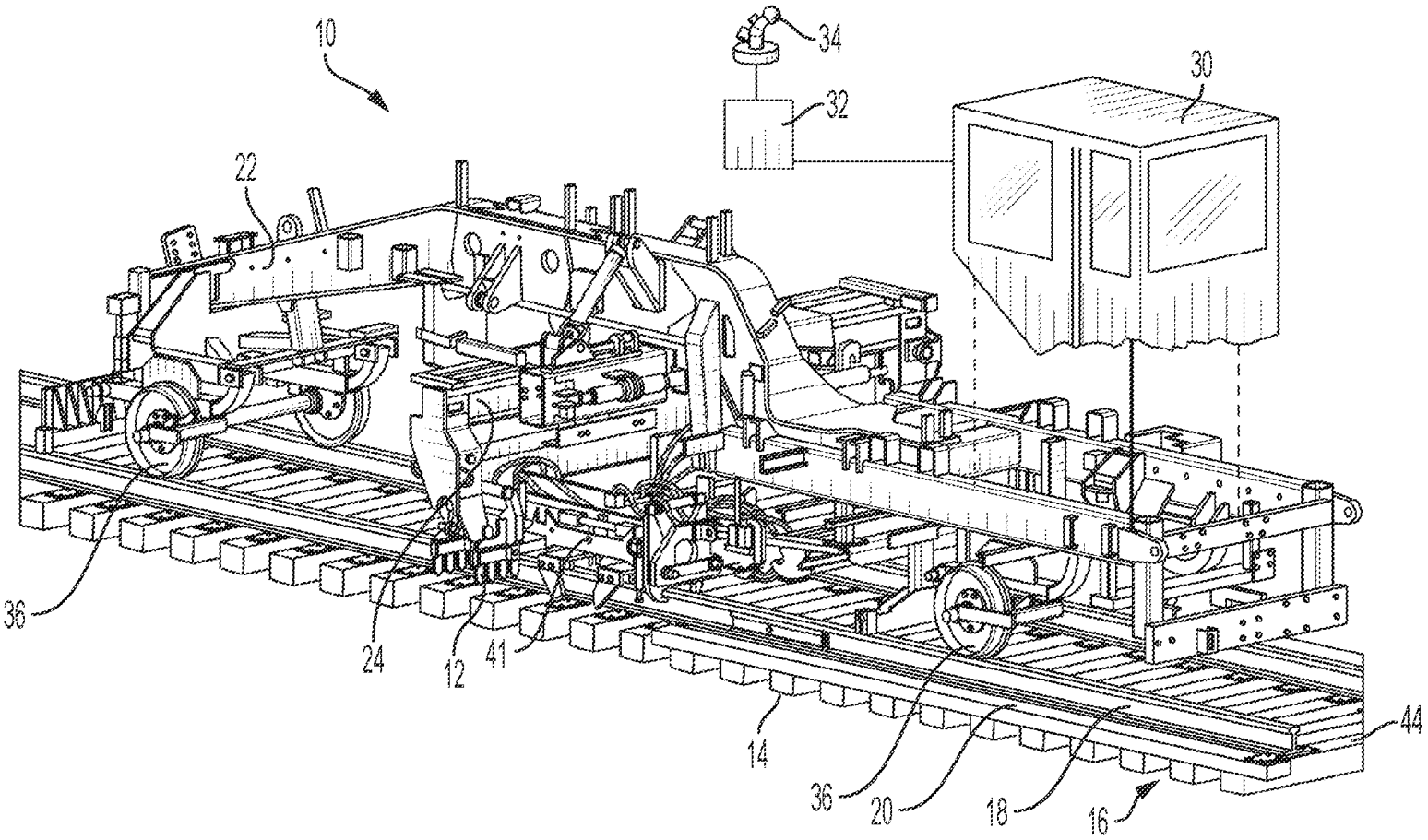
FIG. 1 is a fragmentary exploded, top perspective view of a rail tie exchanger machine of the type suitable for use with the present rail tie guide ski.

Referring now to FIG. 1, a rail tie exchanger or tie replacement machine suitable for use with the present rail ballast management and tie guide ski is generally designated 10. Features of the rail tie exchanger 10 are disclosed in commonly-assigned U.S. Pat. No. 6,463,858, U.S. Ser. No. 16/549,422 and U.S. Ser. No. 16/660,629, all of which are incorporated by reference. As is known in the art, the tie exchanger 10 uses reciprocating tie gripper claws or clamps 12 to grasp a tie 14 of a railroad track 16. To grasp and move the rail ties 14, the claws 12 move between an open and a closed position. The track 16 includes a pair of rails 18, which are secured to the ties 14 with a pair of tie plates 20 on each tie. As is well known, the tie plates 20 are secured to the ties 14 with fasteners such as spikes or screws. These fasteners are removed prior to the tie extraction procedure using a separate spike remover apparatus well known to those in the art.

Also included on the tie exchanger 10 is a main frame 22 from which the gripper claws 12 are suspended via a telescoping arm 24 which reciprocates relative to a hollow beam 26 that projects transversely from the main frame and transversely relative to the rails 18. A fluid power cylinder 28 moves the arm 24 under operator control between an extended position and a retracted position.

An operator's cab 30 is attached to the main frame 22 and houses a control system 32 which as is well known in the art, includes at least one control interface 34 such as a joystick or the like. As is well known in the art, the tie exchanger 10 is preferably movable along the track 16 using a power source (not shown), such as an internal combustion engine, and is provided with flanged rail wheels 36 engaging the track 16. Included on the main frame 22 are a pair of generally parallel, spaced support beams 38 (FIG. 3) that extend transverse to a longitudinal axis of the main frame, as well as the direction of the rails 18.

Figure 2:
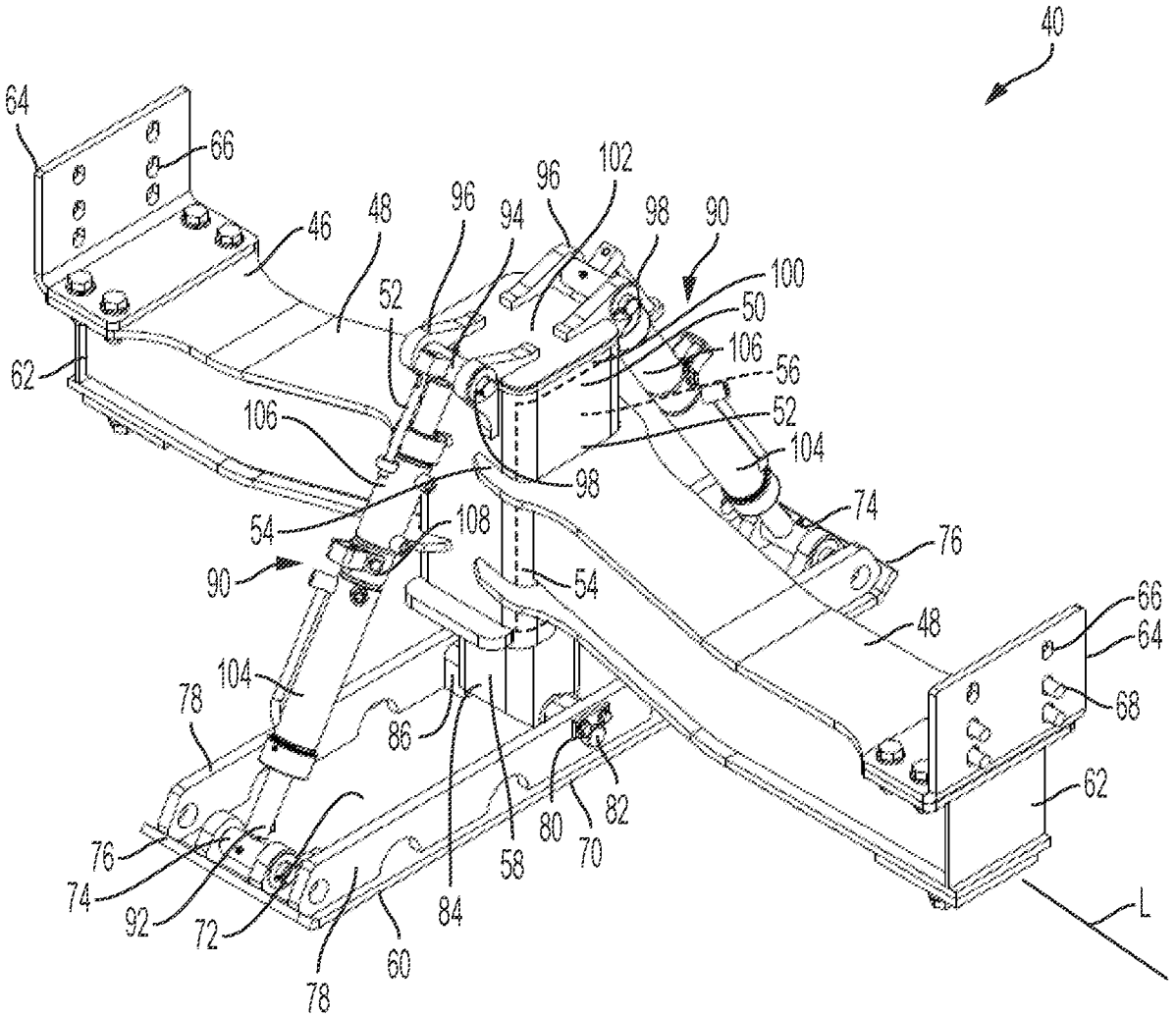
FIG. 2 is a fragmentary top perspective view of the present rail tie guide ski assembly.
Figure 3:
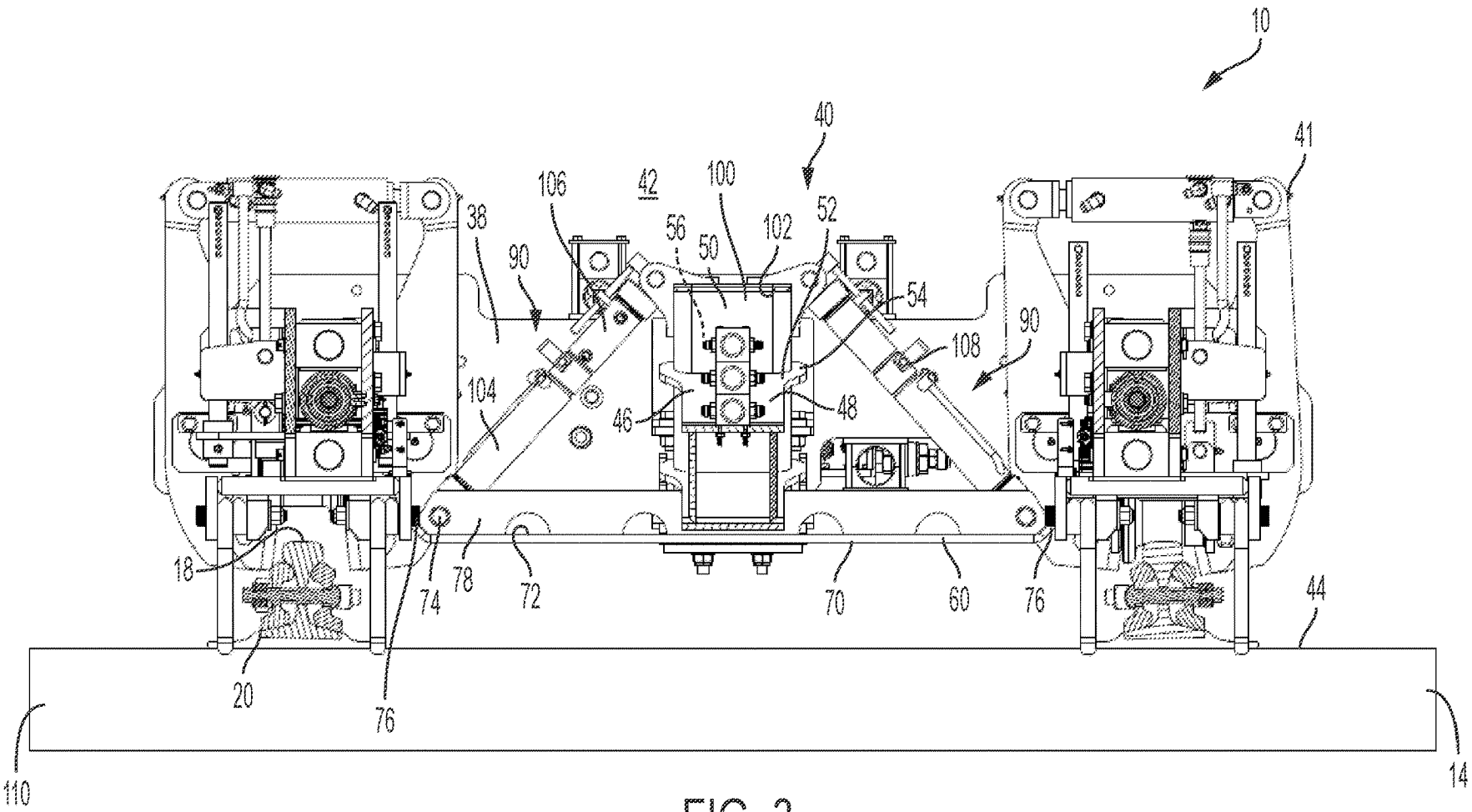
FIG. 3 is a front elevation of the assembly of FIG. 2 in a raised, retracted position.

Referring now to FIGS. 2 and 3, the present rail ballast management and tie guide ski assembly is generally designated 40, and is constructed and arranged for mounting to a plate handler assembly 41 that is mounted to the main frame 22 of the tie exchanger 10 in a work space 42 defined between the spaced support beams 38. In general, the assembly 40 has two purposes, guiding the insertion of a new tie 14 beneath the track 16 so that it is positioned at a designated height, and preventing unwanted ballast particles and rocks from becoming lodged on an upper tie surface 44 during the tie insertion operation.

Included in the assembly 40 is a workhead frame 46 configured for attachment to the tie exchanger 10, and more specifically for attachment in the work space 42 between the support beams 38. As seen in FIG. 2, the workhead frame 46 includes two arms 48, one each connected to a vertically oriented sleeve 50 at an inner end 52. In the preferred embodiment, the inner ends 52 are optionally provided with joint-enhancing gripping tines 54, for enhancing the attachment of the arms 48 to the sleeve 50. Also, the sleeve 50 defines a cavity 56 (shown hidden) dimensioned for slidably engaging a lug 58 that is pivotally attached to a tie ski 60.

Returning to the workhead frame 46, opposite the inner ends 52 of the frame arms 48 are outer ends 62, each equipped with a suitable bracket 64 configured for attaching the workhead frame to the corresponding main frame beams 38. While other configurations are contemplated, in the preferred embodiment, the brackets 64 are "L"-shaped when viewed from the side, and are provided with multiple mounting openings 66 for receiving fasteners 68 such as bolts, rivets, or the like as are known in the art.

The tie ski 60 has a generally planar tie engaging surface 70, an opposite upper surface 72, and a connection point 74 at each of two free ends 76 In addition, the workhead frame 46 has a longitudinal axis "L," (FIG. 2) and the tie ski 60 is mounted transversely to the longitudinal axis. In the preferred embodiment, the tie ski 60 has a pair of vertically projecting side rails 78 which extend longitudinally between the free ends 76. In addition to providing structural support to the tie ski 60, each side rail 78 is provided with a mounting point 80 for a lower end of the mounting lug 58.

During the operation of the assembly 40, the tie ski 60 pivots relative to the mounting lug 58. Accordingly, the mounting lug 58 is pivotally connected to the tie ski 60 by a pin 82 that passes through the mounting point 80 and also through a pivot end 84 of the mounting lug (FIG. 2). Suitable bearings or pillow blocs 86 are optionally provided as are known in the art. Also, as seen in FIGS. 2 and 3, the free ends 76 of the tie ski are angled upward for promoting proper location of the tie ski 60 on the rail tie 14 as will be described in greater detail below. While focusing on the tie ski free ends 76, it will be seen that each end is provided with the connection point 74, which preferably defines a pivot joint. In the preferred embodiment, the connection points 74 are each spaced ears or pillow blocks secured to the tie ski upper surface 72.

Another feature of the present rail ballast management and tie guide ski assembly 40 is a pair of fluid power cylinder assemblies 90 (best seen in FIG. 2), one such assembly connected to a respective connection point 74 at a first end 92, and to the sleeve 50 at an opposite second end 94, such that selective pressurization of the fluid power cylinder assemblies causes reciprocal movement of the tie ski 60 relative to the sleeve 50, and at designated times, the assembly is used to cause pivoting action of the tie ski 60 relative to the sleeve. Accordingly, the sleeve 50 is preferably provided with a pivot bracket 96 configured for connection to the second end 94 of each fluid power cylinder assembly 90. While other structures are contemplated, as are known in the art, in the preferred embodiment, each pivot bracket 96 is preferably configured as a pair of spaced eyelets 98 or pillow blocks, as are known in the art, which are mounted at an upper end 100 of the sleeve 50. As seen in FIG. 2, it is preferred that the upper end 100 of the sleeve 50 has a cover 102, which also defines the cavity 56. Also, as is known in the art, at least one bearing pad 103 (FIG. 4) of the mounting lug 58 within the sleeve 50.

Each of the fluid power assemblies 90 includes a pair of fluid power cylinders (preferably hydraulic cylinders) mounted end-to-end. The cylinders in the assembly 90 include a first, long cylinder 104, connected to a second, short cylinder 106, preferably by welding. A protective cover 108 is provided for an LVDT sensor on the first cylinders 104. The LVDT sensor is used for feedback to control the deployed length of the cylinders. While other configurations are contemplated, in the preferred embodiment, the cylinders 104, 106 are both double acting hydraulic cylinders. Also, in orientation, the first cylinder 104 is disposed closer to the tie ski 60 than the second cylinder 106, which is closer to the sleeve upper end 100. As such, the first cylinder 104 is connected to the connection point 88 at each tie ski free end 76, and each second cylinder 106 is connected to the sleeve pivot bracket 96.

Referring now to FIGS. 1 and 2, each of the fluid power assemblies 90 is connected via suitable hydraulic lines and corresponding solenoid valves and control circuitry, as known in the art, to the tie exchanger control system 32, for operation by the operator using the control interface 34. Individual operator control of each fluid power assembly 90 is preferred, so that one end 76 of the tie ski 60 is movable independently of the other tie ski end. In operation, the first, longer cylinders 104 are configured for controlling the position of the tie ski 60 relative to the rail 18, and the cylinders 104 of both assemblies 90 are employed during each tie insertion cycle of the tie exchanger 10. Use of the shorter, second cylinders 106 is reserved for instances when the tie ski needs to be tilted or angled (FIG. 5), during insertion of the tie 14. More specifically, the cylinder 106 is deployed only on the side opposite insertion and is designed to give-way as the tie 14 is inserted against it. Thus, another name for the second cylinder 106 is the angle or tilt cylinder, which allows some variance as the tie is engaged at the beginning of the insertion operation.

Figure 4:
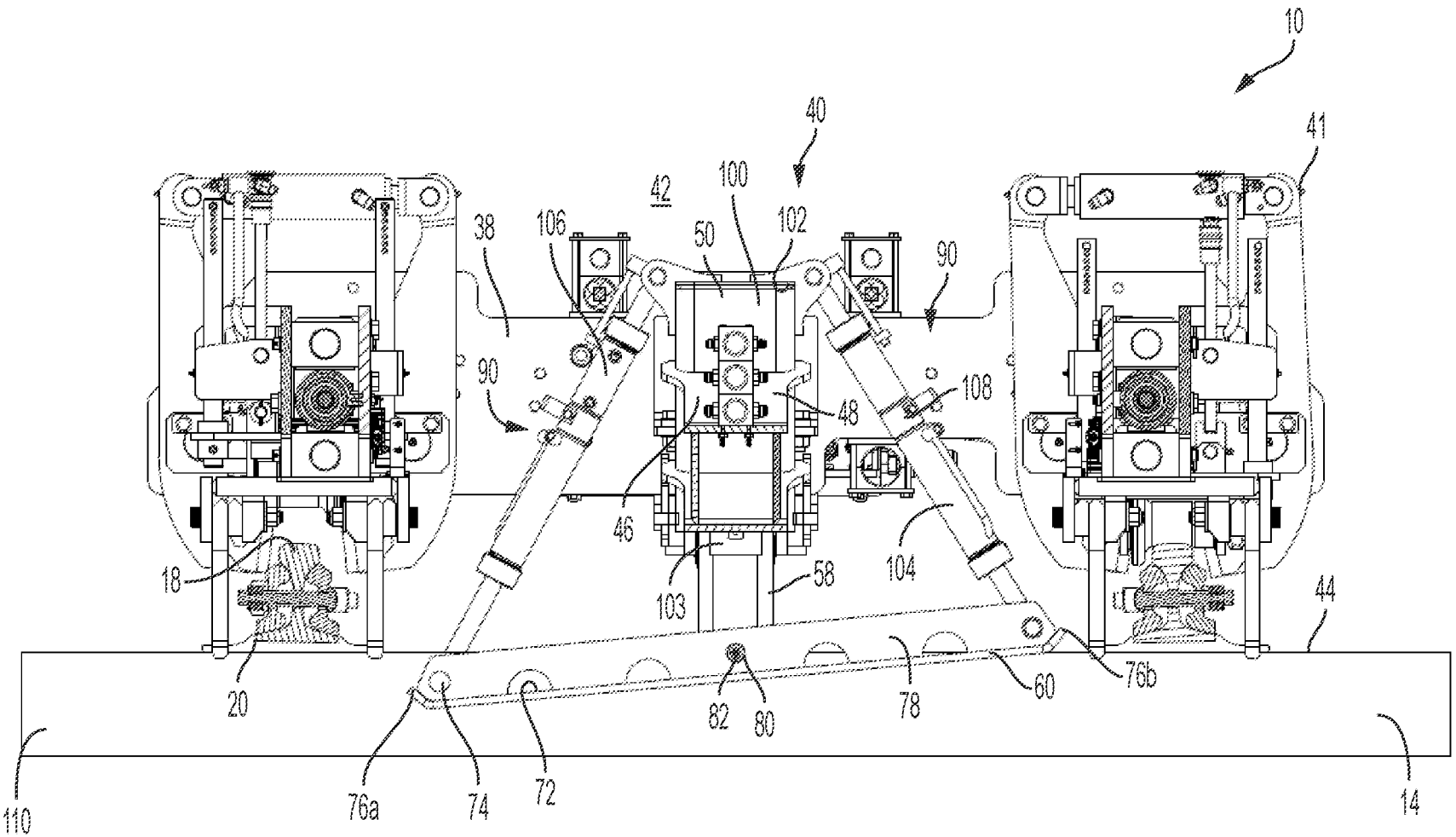
FIG. 4 is a front elevation of the assembly of FIG. 2 in a ski deployed and tilted for insertion of a new tie from the left side.
Figure 5:
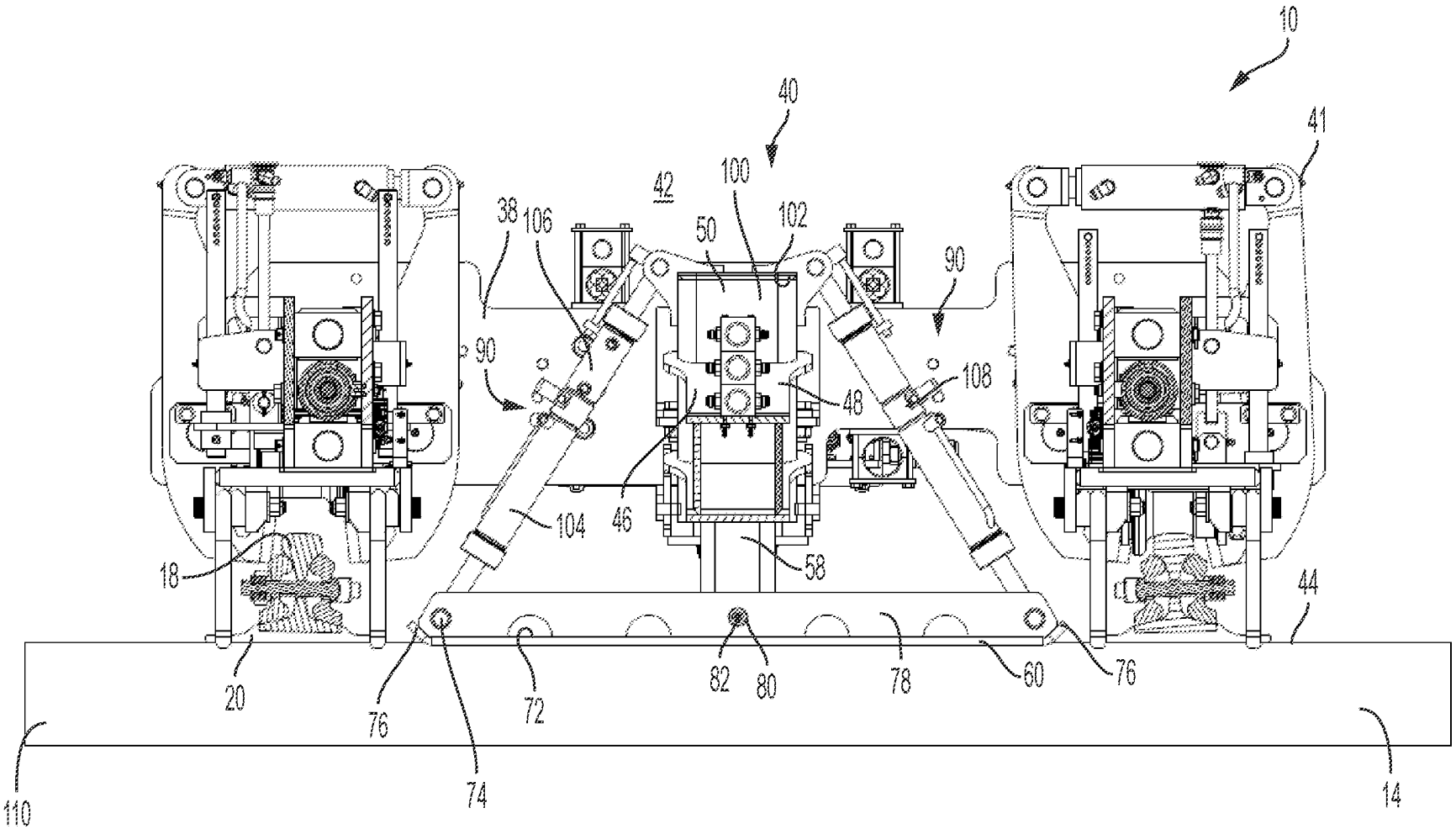
FIG. 5 is a front elevation of the assembly of FIG. 2 in a lowered, deployed position.

Referring now to FIGS. 3-5, the employment of the present tie ski 60 during insertion of the tie 14 will be described in greater detail. First, referring to FIG. 3, tie ski 60 is shown in a retracted, ready or travel position, as the tie exchanger moves between tie extraction and insertion locations along the track 16. Once a target tie 14 has been extracted using the tie gripper clamps 12 and the telescoping arm 24, as is well known in the art, the operator selects a replacement tie 14 and in this case begins insertion from the right side as seen in FIG. 4. The tie gripper clamps 12 grasp the end of the tie 14, and the telescoping arm 24 is manipulated to push the new tie into the designated space beneath the rails 18. As is known in the art, separate clamps hold the tie plates 20 against the rail 18 out of the way of the tie replacement process.

Referring again to FIG. 4, as the new tie 14 is selected and begins insertion, in this case a movement from right to left, the operator activates the tie ski 60 from the ready or travel position of FIG. 3, and lowers the tie ski 60 through use of the cylinders 104, which are actuated in unison to extend the ski from the ready position so that the ski is located closer to the tie 14. As the ski 60 moves closer to the tie 14, the control system activates the shorter, second cylinder 106 on the side farthest from the gripping clamps 12, here the left side, so that the ski end 76*a* is lower than the ski end 76*b*, otherwise referred to as a tilted position.

Also, it is customary for the operator to manipulate the tie gripper clamps 12 and the telescoping arm 24 so that a vertical downward force is exerted on the gripped tie end, so that the ballast in the track 16 is used as a fulcrum that pushes an insertion end 110 of the tie 14 upward. As the operator causes the tie extractor 10 to push the new tie 14 further into position, the tie ski 60 is pressed by the first cylinders 104 so that the tie engaging surface 70 is in contact with the upper surface 44 of the tie 14. This contact prevents the collection of unwanted ballast particles on the upper tie surface 44. Also, the presence of the tie ski 60 acts as a positive stop which prevents the tie 14 from being inserted at too high relative to the track 16. Due to the significant automation of the pressurization of the cylinders 104, 106 and the tie insertion components of the tie extractor 10, the entire tie insertion operation becomes a two-step operation (push tie down at end, push tie in towards far end of track), and reduces digging in the ballast to maintain the ties in a tight engagement with undersides of the rails 18. Upon completion of the tie insertion, the operator manipulates the control interface 34 to return the assembly 40 to the ready position of FIG. 3.

While a particular embodiment of the present rail ballast management and tie guide ski for use with a rail tie exchanger has been described herein, it will be appreciated by those skilled in the art that changes and modifications may be made thereto without departing from the invention in its broader aspects and as set forth in the following claims.

The invention claimed is:

1. A rail ballast management and tie guide ski assembly for use with a rail tie exchanger moving along a railroad track, said assembly comprising:

a workhead frame configured for attachment to the tie exchanger, said frame having a vertically oriented sleeve defining a cavity;

a tie ski having a generally planar tie engaging surface, an opposite upper surface, a connection point at each of two free ends;

a mounting lug dimensioned for slidably engaging said cavity, and pivotally connected to said tie ski; and a pair of fluid power cylinder assemblies, one said assembly connected to a respective connection point at a first end, and to the sleeve at an opposite second end, such that selective pressurization of said fluid power cylinder assemblies causes reciprocal movement of said tie ski relative to said sleeve, wherein an upper end of said sleeve is closed.

2. The tie ski assembly of claim 1, wherein said workhead frame has a longitudinal axis, and said tie ski is mounted transversely to said longitudinal axis.

3. The tie ski assembly of claim 1, wherein said workhead frame is provided with mounting brackets at each of two ends, said brackets configured for mounting to a plate handler assembly on the rail tie exchanger.

4. The tie ski assembly of claim 1, wherein said workhead frame includes two arms, one each connected at an inner end to said sleeve.

5. The tie ski assembly of claim 1, wherein said sleeve has a pair of pivot brackets at the upper end.

6. The tie ski assembly of claim 1, wherein said tie ski has a pair of vertically projecting side rails.

7. The tie ski assembly of claim 6, wherein each said side rail is provided with a mounting point for a lower end of said mounting lug.

8. The tie ski assembly of claim 1, wherein each said connection point on said tie ski is a pivot joint.

9. The tie ski assembly of claim 1, wherein each said fluid power assembly includes a pair of cylinders mounted end-to-end.

10. The tie ski assembly of claim 9, wherein each said pair of cylinders includes a first long cylinder, connected to a second, short cylinder.

11. The tie ski assembly of claim 10, wherein said first cylinder is disposed closer to said tie ski than said second cylinder.

12. The tie ski assembly of claim 11, wherein said first cylinder is connected to said connection point, and said second cylinder is connected to said sleeve.

13. The tie ski assembly of claim 1, wherein said fluid power assemblies are each individually controlled, so that one end of said tie ski is movable independently of another end of said tie ski.

14. The tie ski assembly of claim 1, further including at least one bearing pad disposed between said mounting lug and said sleeve.

15. A rail tie exchanger, comprising:

a main frame having a pair of spaced apart members defining a work space;

a tie ski workhead frame configured for attachment to said spaced apart members of said main frame, said workhead frame having a vertically oriented sleeve defining a cavity;

a tie ski having a generally planar tie engaging surface, an opposite upper surface, a connection point at each of two free ends;

a mounting lug dimensioned for slidably engaging said cavity, and pivotally connected to said tie ski; and a pair of fluid power cylinder assemblies, one such assembly connected to a respective connection point at a first end, and to the sleeve at an opposite second end, such that selective pressurization of said fluid power cylinder assemblies causes reciprocal movement of said tie ski relative to said sleeve, wherein an upper end of said sleeve is closed.

16. A method of extraction and insertion of a tie on a railroad track using a rail tie extractor, comprising:

pulling an existing tie laterally from beneath rails of the track;

providing a vertically reciprocating tie ski slidable relative to a sleeve between a retracted position and an extended position;

as a new tie is positioned for insertion beneath the rails, activating the tie ski to the extended position;

further activating the tie ski so that one end of the ski is tilted relative to another end;

manipulating the new tie so that an insertion end of the tie engages a lower end of the tie ski; and once the tie ski is engaged on an upper surface of the tie, completing the the insertion of the tie.

* * * * *